US005829066A

United States Patent [19]

Aibe

[11] Patent Number: 5,829,066

[45] Date of Patent: Nov. 3, 1998

[54] DEODORIZING APPARATUS AND A TOILET PROVIDED WITH THE APPARATUS

[75] Inventor: Toshio Aibe, Toyonaka, Japan

[73] Assignee: Takeda Chemical Industries, Ltd., Japan

[21] Appl. No.: 93,664

[22] Filed: Jul. 20, 1993

Related U.S. Application Data

[63] Continuation of Ser. No. 793,107, Nov. 15, 1991, abandoned.

[30] Foreign Application Priority Data

Nov. 19, 1990 [JP] Japan ..... 2-314975
Jul. 12, 1991 [JP] Japan ..... 3-198558

[51] Int. Cl.[6] ..... E03D 9/052
[52] U.S. Cl. ..... 4/213
[58] Field of Search ..... 4/213

[56] References Cited

U.S. PATENT DOCUMENTS

| | | | |
|---|---|---|---|
| 2,846,696 | 8/1958 | Herriott | 4/213 |
| 4,025,325 | 5/1977 | Goodwin, Jr. | 4/209 FF |
| 4,317,242 | 3/1982 | Stamper | 4/213 |
| 4,370,301 | 1/1983 | Doi et al. | 422/122 |
| 5,043,310 | 8/1991 | Takeuchi et al. | 502/404 |
| 5,145,657 | 9/1992 | Kobayashi et al. | 433/219 |

FOREIGN PATENT DOCUMENTS

| | | | |
|---|---|---|---|
| 0331192 | 6/1989 | European Pat. Off. . | |
| 52-63882 | 5/1977 | Japan . | |
| 59-135977 | 9/1984 | Japan . | |
| 59-227704 | 12/1984 | Japan . | |
| 61-20138 | 6/1986 | Japan . | |
| 61-135974 | 8/1986 | Japan . | |
| 64-677 | 1/1989 | Japan . | |
| 0268929 | 10/1989 | Japan | 4/213 |
| 2088719 | 6/1982 | United Kingdom . | |

OTHER PUBLICATIONS

Mizutani, "Activated Charcoal for Deodorization", Translation of JP Kokai 52–63882, May 26, 1977.

K.K. Kiyousera, Pat. Abstracts of Japan, vol. 9, (No. 96) Apr. 25, 1985 & JP–A–59 227 704 Dec. 21, 1984.

*Primary Examiner*—Robert M. Fetsuga
*Attorney, Agent, or Firm*—Foley & Lardner

[57] ABSTRACT

The deodorizing apparatus includes a gas duct having a suction port to be disposed within a toilet bowl and an exhaust port to be disposed outside the toilet bowl, and an active carbon honeycomb and a chemical-supporting honeycomb as disposed within the gas duct in that order in the direction from the suction port to the exhaust port. The deodorizing apparatus further includes a motor operative in response to a sensor detection signal representing the user sitting on the stool seat to drive a fan disposed downstream within the gas duct, and a timer operative in response to a sensor detection signal representing the user leaving the stool seat to control the operation time of the motor. There may also be provided a damper for opening and closing the gas duct in response to the action of the fan.

23 Claims, 14 Drawing Sheets

DEODORIZING APPARATUS AND A TOILET PROVIDED WITH THE APPARATUS

This application is a continuation of U.S. application Ser. No. 07/793,107 filed Nov. 15, 1991 now abandoned.

FIELD OF THE INVENTION

The present invention relates to a deodorizing apparatus for eliminating the malodor of urine and feces from a toilet and to a toilet provided with the apparatus.

BACKGROUND OF THE INVENTION

As an apparatus for removing the malodor of urine and feces within a toilet, Japanese Utility Model Publication No. 20138/1986 discloses a deodorizing apparatus comprising an active carbon and either a deodorant or a perfume source accommodated in a gas duct within a stool seat box, a fan motor and a solenoid which are disposed upstream and operable by a switch at the seat, and a damper disposed in the gas duct to selectively make the active carbon and other agent available or unavailable in use of the toilet. Japanese Utility Model Application Laid-open No. 135974/1986 discloses a deodorizing unit which has a fan motor in an upstream position, contains active carbon, a sponge and a perfume source, and can be affixed to a toilet. There also is known a deodorizing method which comprises drawing the malodor of urine and feces from the bowl through its flush water port and feeding it to a deodorizing unit packed with a deodorant through the overflow pipe of the cistern.

Furthermore, U.S. Pat. No. 4,317,242 to R. H. Stamper discloses a device for the removal of foul air from the toilet bowls. The device comprises a conduit having an inlet opening disposed within the bowl and outlet opening(s) disposed outside the bowl and having a hook shape to hook over the rim of the bowl, a pressure sensitive switch member, air treatment means such as activated carbon or charcoal, and a battery-operable fan to draw foul air from the inlet opening.

However, since these deodorizing apparatuses and methods invariably employ granular or pelletized active carbon, the gas flow through the active carbon bed cannot be uniform and the flow resistance of the gas is high. The increases of the flow resistance cause the increases of the load on the motor and the fan, and of electric power consumption, and the motor and the fan produce a disturbed noise. As a consequence, various malodor components cannot be efficiently eliminated. Moreover, the moisture contained in the gas tends to condense within the carbon bed so that the deodorizing efficiency falls progressively within a short period of time. In addition, because the active carbon is granular or pelletized, for instance, the replacement work is complicated. Moreover, whether such active carbon is used alone or in combination with a sponge, a perfume source and/or the like, the malodor components which can be removed are limited. Therefore, the deodorizing efficiency is low.

Furthermore, since the fan motor is disposed on the upstream side of a gas duct, it is corroded by hydrogen sulfide, mercaptans, ammonia, amines, etc. so that the deodorizing effect is inevitably short-lived.

SUMMARY OF THE INVENTION

It is, therefore, an object of the present invention to provide a deodorizing apparatus and a toilet which can eliminate malodor components from the toilet smoothly and efficiently and over a long time.

It is another object of the invention to provide a deodorizing apparatus and a toilet which are free from the problem of corrosion of the fan motor and capable of retaining a high deodorizing efficiency over a long period of time.

It is still another object of the invention to provide a deodorizing apparatus and a toilet which ensure positive aspiration and elimination of malodor components without allowing them to escape from the toilet bowl and the apparatus.

It is a further object of the invention to provide a deodorizing apparatus and a toilet which are indifferent to the adverse effects of the moisture present within the bowl, permit effective utilization of active carbon in the form of a honeycomb, and are free from deterioration of deodorizing efficiency.

It is still another object of the invention to provide a deodorizing apparatus and a toilet which are capable of eliminating malodors with high efficiency, not only during urination or defecation but also for a certain time after urination or defecation.

It is a further object of the invention to provide a deodorizing apparatus and a toilet which are provided with a function to indicate the end of the useful life of the active carbon honeycomb and alert the user to the need for replacement.

To accomplish the above-mentioned objects, the present invention provides a deodorizing apparatus comprising a gas duct having a suction port to be disposed within a toilet bowl and an exhaust port to be disposed outside the toilet bowl, and an active carbon honeycomb and a chemical-supporting active carbon honeycomb as disposed in that order in the gas duct in the direction from the suction port to the exhaust port. A casing defines the gas duct.

A deodorizing apparatus comprises a gas duct having a suction port which can be positioned within a toilet bowl for directing gases out of the toilet bowl and into the gas duct and an exhaust port which can be positioned outside the toilet bowl for emitting gases from the gas duct; and an active carbon honeycomb and a chemical-supporting active carbon honeycomb which can be positioned in the gas duct for directing the gases out of the toilet bowl through the active carbon honeycomb and the chemical-supporting active carbon honeycomb in that order. One active carbon honeycomb and one chemical-supporting active carbon honeycomb are preferably disposed in the gas duct in single layer form, respectively.

In this deodorizing apparatus, a fan may be disposed in the gas duct on the downstream side of the chemical-supporting active carbon honeycomb. In addition to the fan, a damper for opening or closing the gas duct in response to the action of the fan may also be disposed within the gas duct. The suction port side of the casing may be in a bent form, e.g. U-shaped.

The BET (Brunauer-Emmett-Teller equation) specific surface area of the active carbon honeycomb may, for example, be not less than 200 $m^2/g$, and the number of cells in the active carbon honeycomb and in the chemical-supporting active carbon honeycomb may, for example, be 30 to 1500 cells/square inch. The chemical-supporting active carbon honeycomb includes those honeycombs supporting acids, bromine, or compounds of platinum group elements.

The present invention provides a toilet provided with the deodorizing apparatus described above. The toilet is provided with a deodorizing apparatus comprising a gas duct having a suction port and an exhaust port, and an active carbon honeycomb and a chemical-supporting active carbon honeycomb as disposed in that order in the gas duct in the direction from the suction port to the exhaust port, with the suction port and exhaust port being disposed internally and externally, respectively, of the toilet bowl.

The deodorizing apparatus may be disposed in a portion of a toilet bowl which can be opened and closed. The bent portion of the casing may rest on the upper circumferential edge of the bowl.

In the deodorizing apparatus and toilet described above, the malodor drawn into the suction port by the action of the fan is treated by the active carbon having a honeycomb structure. This active carbon honeycomb structure features a remarkably reduced gas flow resistance as compared with granular or pelletized active carbon, thus ensuring a uniform and smooth flow of gas, and its deodorizing efficiency is not affected by the moisture contained in the gas. Moreover, because of the honeycomb structure, replacement of active carbon is facilitated. In addition, since such an active carbon honeycomb is used in combination with a chemical-supporting active carbon honeycomb in the above-described arrangement, many different malodor components such as hydrogen sulfide, methylmercaptan, methyl disulfide, ammonia, trimethylamine, etc. can be nearly completely eliminated. Because of this arrangement plus the aforementioned honeycomb structure of active carbon, a high deodorizing efficiency can be maintained for a long period of time.

In another form of the present invention, the deodorizing apparatus includes a sensor for detecting the user sitting on the seat and leaving the seat, a driving means operative in response to a sitting detection signal from the sensor to drive a fan in the gas duct, and a control means operative in response to a leaving detection signal from the sensor to control the operation time of the driving means. The control means may comprise a timer means for energizing the driving means for a predetermined time, and a set/reset means responsive to either the sitting detection signal or the leaving detection signal to reset or set the timer means. An indicator may also be included to inform the user of the life of the active carbon honeycombs or the replacement time.

A variety of sensors may be used as the sensor for detecting the user sitting on or leaving the seat, such as a photosensor whose sensing axis extends obliquely upwardly from the exterior region to the interior region of the toilet can be employed. The deodorization, during the user sitting on the seat, is conducted by the driving means which drives the fan in response to the sitting detection signal. The sustained deodorization after urination or defecation can also be ensured by a timer means which allows the driving means to operate for a predetermined time in response to the leaving detection signal.

These objects and advantages of the present invention will be better understood from the detailed description with reference to the accompanying drawings and the test examples.

DETAILED DESCRIPTION OF THE PREFERRED EMBODIMENTS OF THE INVENTION

Figure 1:
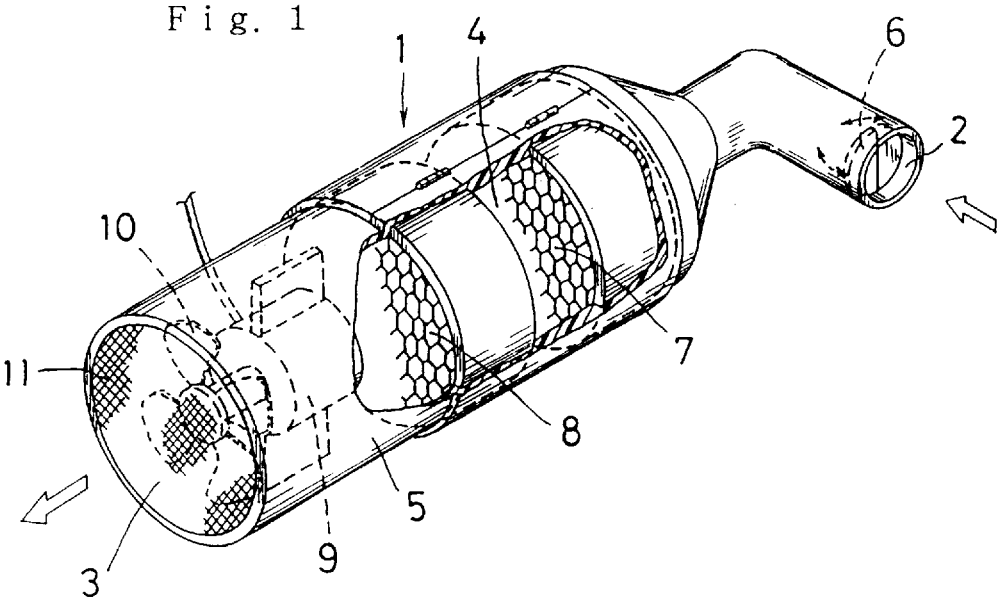
FIG. 1 is a partially exploded schematic perspective view showing a deodorizing apparatus of the invention.
Figure 2:
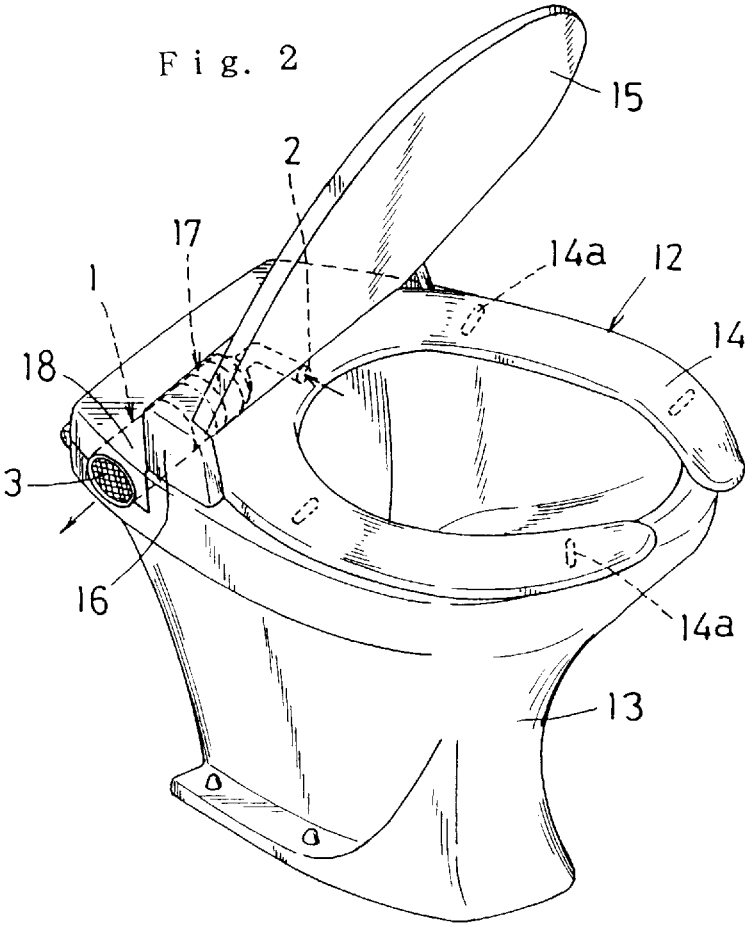
FIG. 2 is a schematic perspective view of the toilet provided with the deodorizing apparatus of FIG. 1.

FIG. 1 is a partially exploded schematic perspective view showing a deodorizing apparatus of the invention, and FIG. 2 is a schematic perspective view showing a Western-style toilet provided with the deodorizing apparatus shown in FIG. 1.

The deodorizing apparatus 1 comprises a hollow cylindrical casing 5 defining a gas duct 4 having a suction port 2 to be disposed within a toilet bowl 13 and an exhaust port 3 to be disposed outside the toilet bowl 13, a damper 6 disposed in a portion of the casing 5 which is closer to the suction port 2, an active carbon honeycomb 7 and a chemical-supporting active carbon honeycomb 8 disposed in the direction from the suction port 2 to the exhaust port 3 in that sequence, and a motor 9 and a fan 10 which are disposed downstream of the chemical-supporting active carbon honeycomb 8, that is to say closer to the exhaust port 3 side of the gas duct.

The suction side of the casing 5 is L-configured. Moreover, in order that the active carbon honeycomb 7 and chemical-supporting active carbon honeycomb 8 may be removed and reinstalled as desired, the corresponding portion of the casing 5 is constituted so that it can be freely opened and closed by hinge means. The damper 6 is pivotally mounted on the casing 5 in a position close to the suction port 2 so as to open or close the gas duct 4 on the suction port 2 side in response to the action of the fan 10. The exhaust port 3 of the casing 5 is provided with a mesh-type or otherwise gas-permeable protective member 11 for preventing fouling of the fan 10.

The above deodorizing apparatus 1 can be installed in such a manner that the suction port 2 thereof is disposed within the toilet bowl 13 and the exhaust port 3 is disposed outside the toilet bowl 13. Thus, an illustrated in FIG. 2, the toilet 12 comprises a toilet bowl 13, a stool seat 14 and a cover 15, with a stool seat box 16 formed at the base of the seat 14.

The seat 14 is provided with projections 14*a* which are adapted to contact the rim (top circumferential edge) of the bowl 13. The rear part of the bowl 13 which is closer to a cistern or flushing water tank (not shown) is formed with a receptor means 17 for accepting the deodorizing apparatus 1, and the receptor means 17 can be covered or exposed by a hinged cover 18. The receptor means 17 extends in the shape of the letter L from a side opening in the bowl 13 to an inner opening as illustrated. Thus, the receptor means is complementary to the deodorizing apparatus in shape and size. Therefore, the deodorizing apparatus 1 can be installed and removed with respect to the receptor means 17 of the bowl 13 after opening the cover 18.

With this deodorizing apparatus 1, the malodorous component such as urine odor within the toilet 12 is aspirated by the fan 10 associated with the motor 9 from the suction port 2 through the damper 6, brought into contact with the active carbon honeycomb 7 and the chemical-supporting active carbon honeycomb 8 in that order and finally exhausted from the exhaust port 3. In this arrangement, since the active carbon and chemical-supporting active carbon are each in the form of a honeycomb, not only is the flow resistance low but the flow of gas is made uniform so that the active carbon honeycomb 7 and the chemical-supporting active carbon honeycomb 8 are efficiently supplied with the gas to be treated.

As a result, the malodorous components are thoroughly eliminated by the active carbon honeycomb 7 and the chemical-supporting active carbon honeycomb 8. Thus, sulfur compounds such as hydrogen sulfide, mercaptans (e.g. methylmercaptan, etc.) and hydrocarbons are mostly removed by the active carbon honeycomb 7, while nitrogen compounds such as ammonia, trimethylamine, etc. are mainly eliminated by the chemical-supporting active carbon honeycomb 8.

Furthermore, because the motor 9 and the fan 10 are located on the exhaust side of the casing 5, their corrosion due to sulfur compounds such as hydrogen sulfide, mercaptans, e.g. methylmercaptan and the like, nitrogen compounds such as ammonia, amines, etc., aldehydes, sulfides and so on can be prevented and, hence, a high deodorizing efficiency can be maintained over a long time. Moreover, since a suction force is applied by the fan 10 which is disposed closer to the exhaust port of the casing 5, the malodor can be drawn positively even if there are small openings such as assembling clearances with respect to the honeycombs 7,8, cracks or pinholes in the casing 5, or the like, so that it does not happen that the malodor components do not escape from the apparatus.

In addition, because the activated carbon and chemical-supporting active carbon are in the honeycomb form, the respective honeycombs 7,8 can be easily replaced with fresh ones. Installing and removing of the deodorizing apparatus 1 with respect to the receptor 17 of the toilet bowl 13 through the cover 18 is also easy. Moreover, since the damper 6 is operative in response to the action of the motor 9 and fan 10 opens the gas duct 4 only while the motor 9 is operating and closes it at other times, there is no adverse effect caused by the moisture present in the toilet 12 and the active carbon honeycombs can be utilized effectively and efficiently with suppressed loss of their adsorbent activity.

It should be understood that the casing need not be in the bent form but also may be provided in any appropriate form as long as its suction port and exhaust port can be disposed internally and externally of the toilet bowl, respectively. Furthermore, the motor of the deodorizing apparatus may be actuated by inserting a plug connected to the motor into a household power outlet or by means of an appropriate means such as a switch provided within the toilet user's reach. However, it is preferable to have the motor be automatically started by a sensor which senses urination, defecation, sitting on the seat or leaving the seat. Since the malodor remains within the toilet 12 for some time after urination or defecation, it is preferable to keep driving the motor 9 for a predetermined time after urination or defecation. Setting the cover 15 down onto the seat after leaving the seat 14 prevents the malodor from leaking out from the toilet 12, thus contributing to an enhanced air freshening effect.

Figure 3:
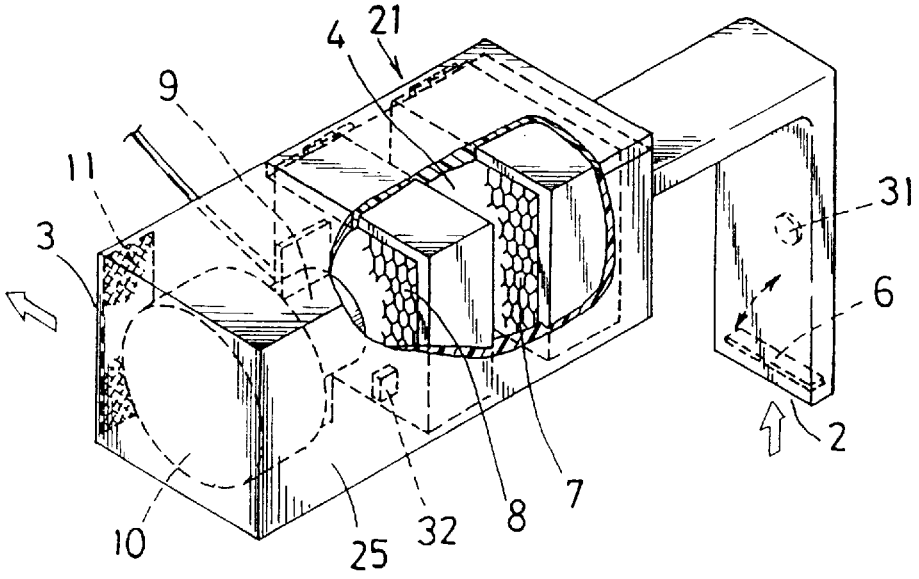
FIG. 3 is a partially exploded schematic perspective view showing another embodiment of the invention.
Figure 4:
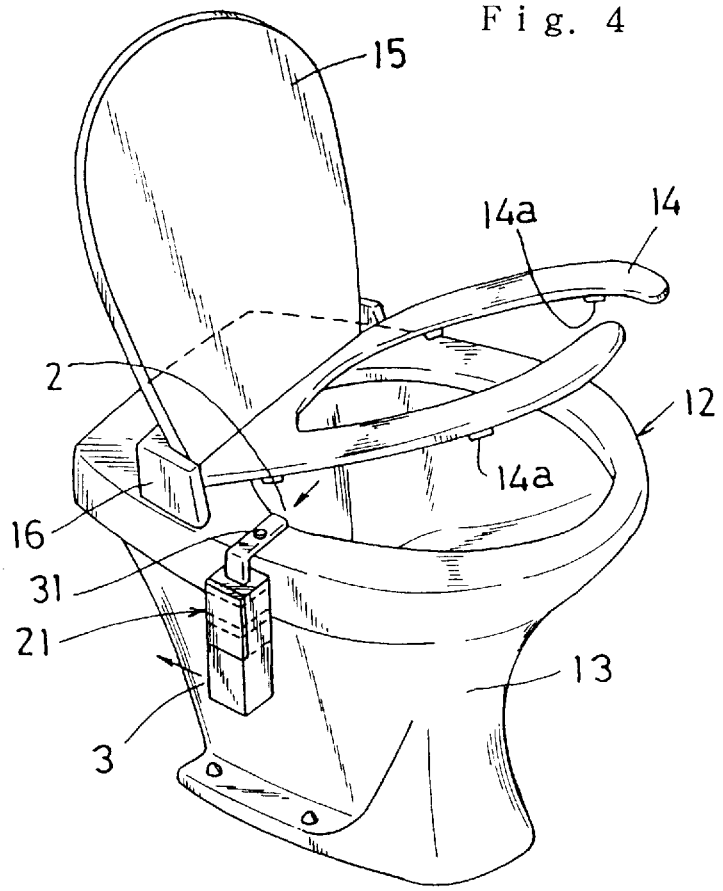
FIG. 4 is a schematic perspective view showing a toilet provided with the deodorizing apparatus of FIG. 3.

FIG. 3 is a partially exploded schematic perspective view showing another embodiment of the invention and FIG. 4 is a schematic perspective view showing a toilet provided with the deodorizing apparatus of FIG. 3. In these figures, the like parts are designated by the like numerals used in the description of the preceding embodiment.

The deodorizing apparatus 21 is designed with attention to the clearance formed between the top circumferential surface of the bowl 13 and the underside of the seat 14 due to the presence of projections 14*a* on the underside of the seat 14. Thus, the portion of the casing 25 closer to the suction port is formed with a thickness corresponding to the clearance and bent in the form of the letter L for hooking over the rim and suspending from the rim of the bowl 13.

Moreover, the portion of the casing 25 on the suction port side which is to face the seat 14 is provided with an automatic switch 31, such as a photosensor, a pressure sensor or an odor sensor, which detects the user sitting on the seat and actuates the motor 9. In addition, the portion of the casing 25 where the active carbon honeycomb 7 and chemical-supporting active carbon honeycomb 8 are installed and removed is internally formed to present a polygonal shape complemental to the shape of said active carbon honeycomb 7 and chemical-supporting active carbon honeycomb 8, while the portion where a sirocco fan 10 is mounted is formed as a hollow cylinder in section.

The malodor remains within the toilet 12 after defecation or urination. Therefore, in order that the fan 10 may be driven by the motor 9 for a predetermined time after the user leaves the seat 14, it is so arranged that leaving the seat triggers a built-in timer 32 of the casing 25 to control the operation time of the motor 9. In this connection, by setting the cover 15 down onto the seat, an enhanced deodorizing efficiency can be further ensured.

For secure setting of the deodorizing apparatus, the part of the underside of the casing 25 which corresponds to the circumferential part of the bowl 13 may be formed with a recess, or the portion of casing 25 which is close to the suction port 2 may be provided with a fixing means adapted to engage the bowl 13.

The toilet deodorizing apparatus is preferably provided, as aforesaid, with a sensor for detecting the user sitting on the seat or leaving the seat, a driving means operative in response to a sitting detection signal from the sensor to drive the fan, and a control means which controls the duration of operation of the driving means in response to a detection signal representing the user leaving the seat.

Figure 5:
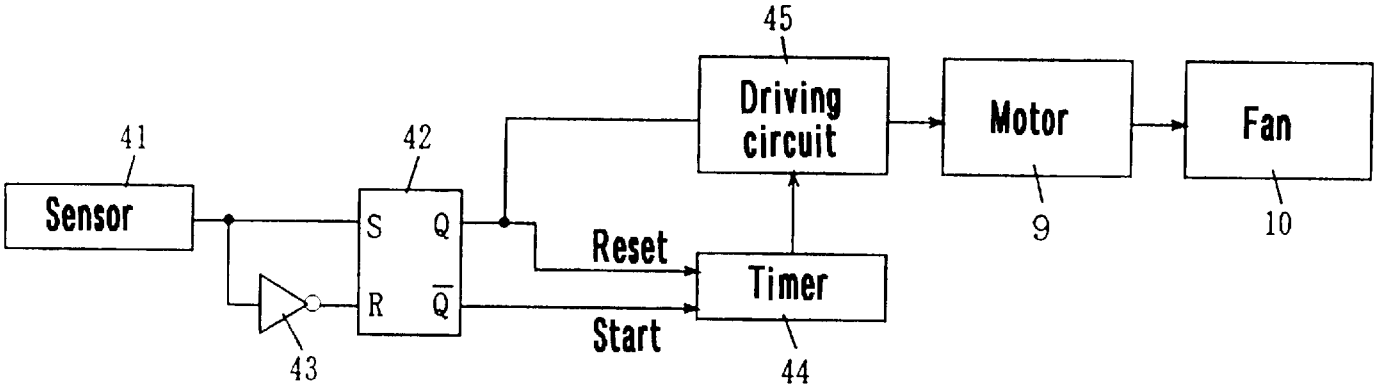
FIG. 5 is a block diagram showing the electrical system used in another deodorizing apparatus according to the invention.

FIG. 5 is a block diagram showing the electrical system used in another deodorizing apparatus of the invention.

The deodorizing apparatus is equipped with a sensor 41, for example a photosensor, a pressure sensor, an odor sensor, a temperature sensor or the like, for detecting the user sitting on the seat 14 and leaving the seat 14 in the position corresponding to the bowl 13 or the seat 14. The sitting detection signal from the sensor 41 is fed to an S-terminal of a flip-flop 42 and, at the same time, to an R-terminal of the flip-flop 42 through an inverter 43. When the sensor 41 senses the user sitting, the detection signal becomes "1", the flip-flop 42 is set, and the output signal Q of the flip-flop 42 becomes "1". A timer 44 is reset by the output signal Q. In response to the output signal Q, a driving circuit 45 is switched ON so that a driving signal is applied to the motor 9. The motor 9 drives the fan 10 to initiate a deodorizing session.

On the other hand, when the user leaves the seat 14 after defecation or urination, the detection signal of the sensor 41 becomes "0", the flip-flop 42 is reset and the output signal $\overline{Q}$ of the flip-flop 42 becomes "1". The output signal $\overline{Q}$ "1" corresponds to the detection signal representing the user's leaving the seat 14. In response to the output signal $\overline{Q}$, the timer 44 starts counting and the driving circuit 45 goes ON so that a driving signal is applied to the motor 9 to drive the fan 10 for a predetermined time. In this manner, the malodor that stays within the bowl after defecation or urination can be successfully eliminated. As the time set on the timer 44 runs out, the driving circuit 45 is switched OFF to stop the motor 9.

In the above apparatus, the toilet user sitting on the seat 14 causes the fan 10 to turn and resets the timer 44. Moreover, leaving the seat 14 causes the timer 44 to start counting and allows the fan 10 to keep turning for a preset time so as to efficiently remove the residual malodor.

While the time to be set on the timers 32,44 may be chosen with reference to the capacity of the motor 9 and the volumetric capacity of the fan 10, for instance, it is preferable to arrange so that the motor 9 may be driven for at least 10 seconds after the user has left the stool seat 14.

Figure 6:
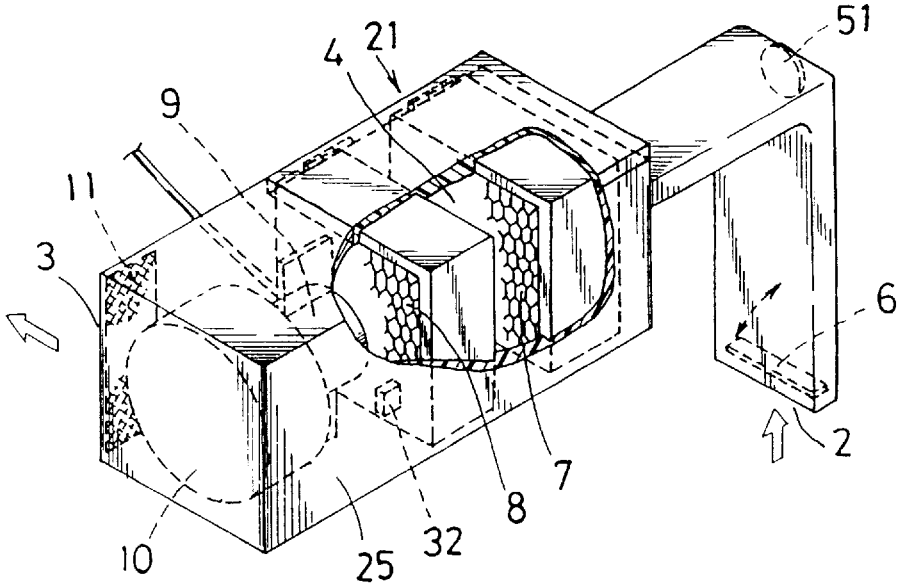
FIG. 6 is a partially exploded schematic perspective view showing still another deodorizing apparatus according to the invention.
Figure 7:
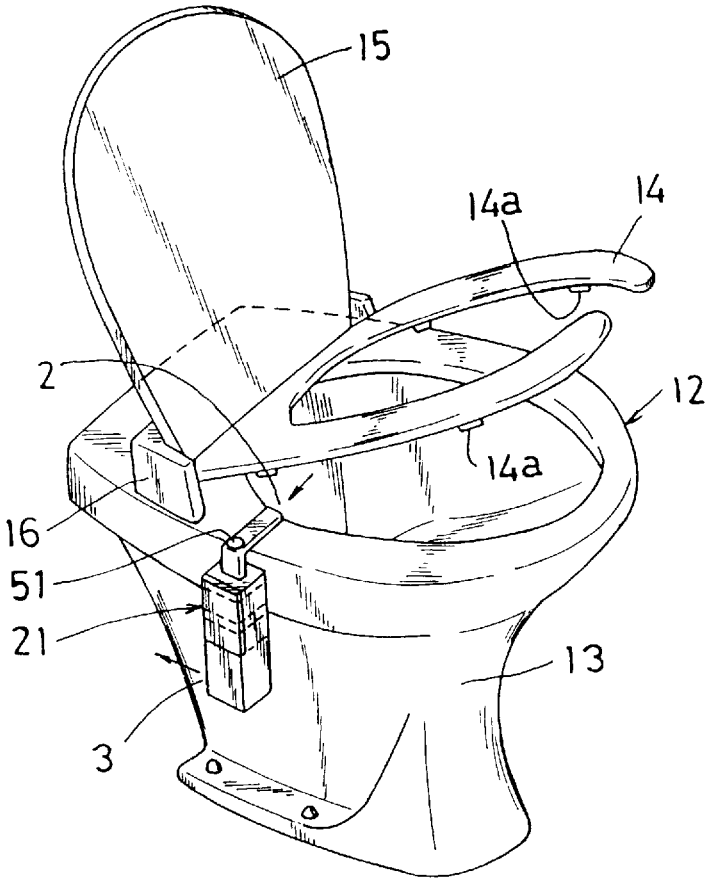
FIG. 7 is a schematic perspective view showing a toilet provided with the deodorizing apparatus of FIG. 6.

In the practice of the present invention, any suitable type of sensor may be used as long as only if it is capable of sensing defecation, urination, sitting on the seat or leaving the seat, but a photosensor such as an infrared beam sensor is preferred. FIG. 6 is a partially exploded schematic perspective view showing another deodorizing apparatus of the invention, and FIG. 7 is a schematic perspective view showing a toilet provided with the deodorizing apparatus of FIG. 6.

Here, instead of the sensor 41, a photosensor 51 for sensing the user sitting on the seat 14 or leaving the seat 14 is disposed on the upper side portion of the deodorizing apparatus 21 as illustrated. The sensing direction of the photosensor 51 is one in which the user sitting and leaving can be detected, for example obliquely upwards from the exterior to the interior of the toilet 12. The deodorizing apparatus functions in a similar manner and is fundamentally similar, in operation and effect, to the apparatus shown in FIGS. 3 and 4, except that sitting and leaving can be detected in a contactless manner.

Figure 8:
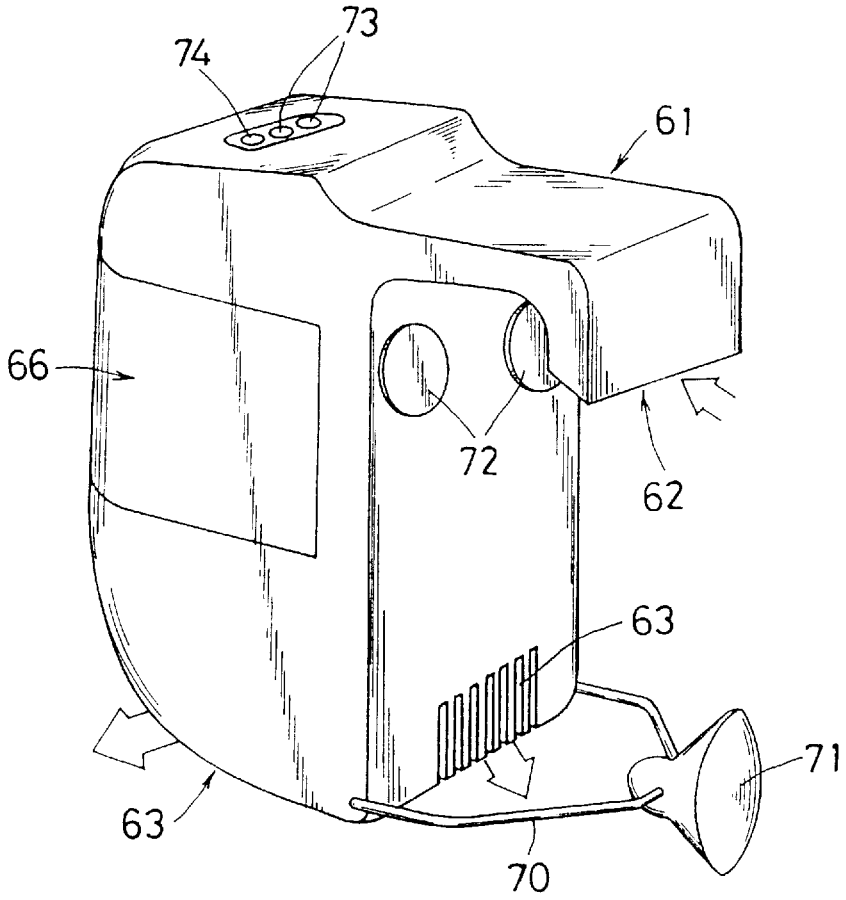
FIG. 8 is a schematic perspective view showing a further deodorizing apparatus embodying the principles of the invention.
Figure 9:
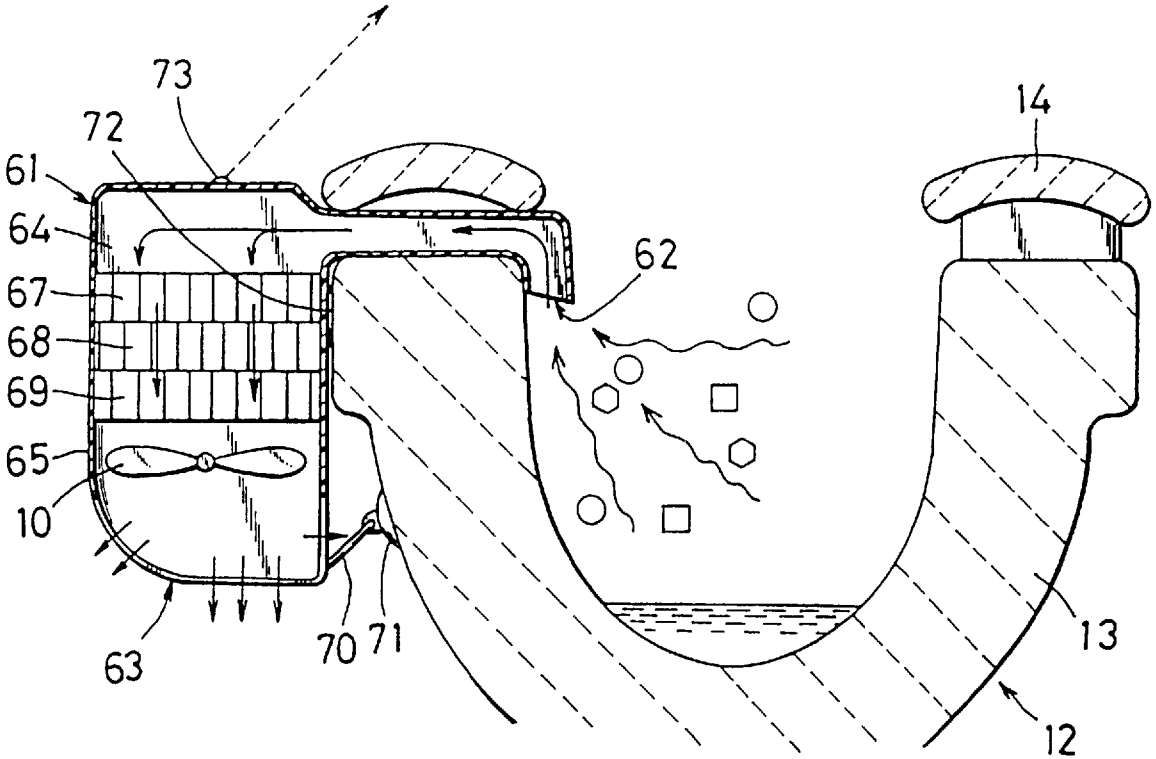
FIGS. 9(A) and 9(B) are schematic cross-sectional views showing a toilet provided with the deodorizing apparatus of FIG. 8.
Figure 9:
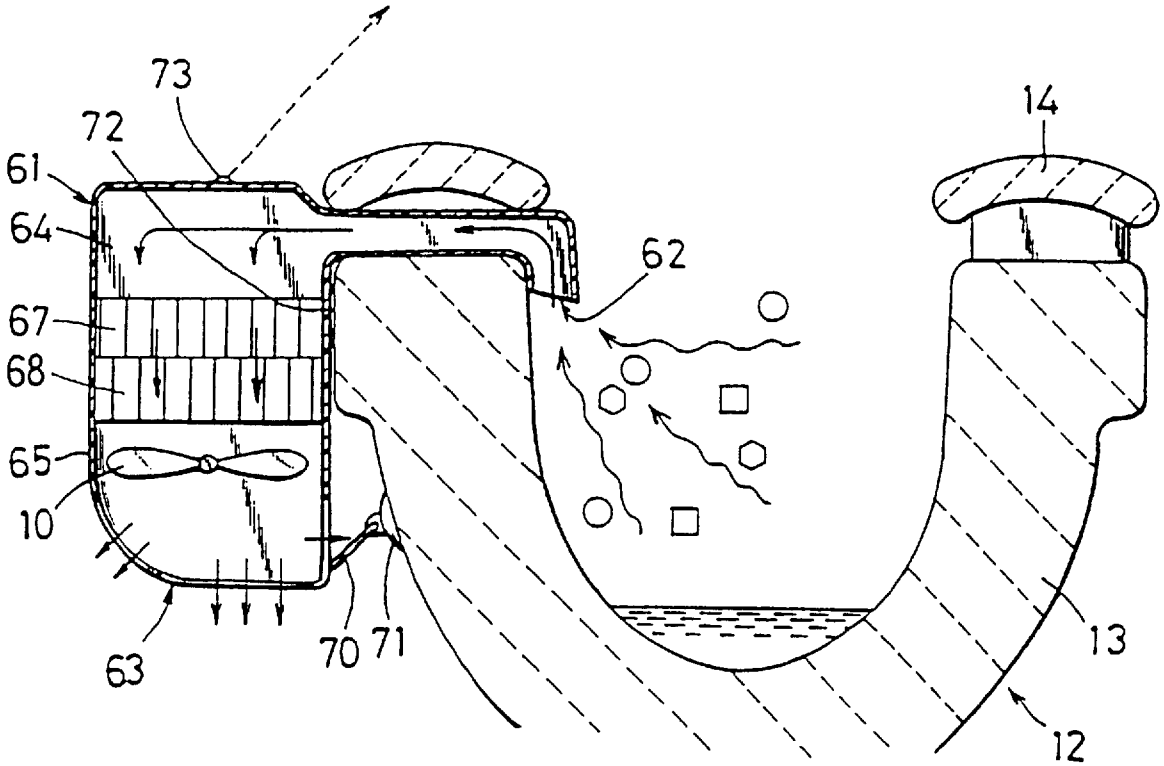

FIG. 8 is a schematic perspective view showing still another deodorizing apparatus of the invention, and FIGS. 9(A) and 9(B) are schematic cross-sectional views of a toilet provided with the deodorizing apparatus of FIG. 8.

The deodorizing apparatus 61 comprises a casing 65 having a suction port 62 and an exhaust port 63, and a replaceable cartridge 66 housing an active carbon honeycomb 67 and a couple of chemical-supporting active carbon honeycombs 68,69, the cartridge being snugly accommodatable between the suction port 62 and the exhaust port 63. Disposed downstream of the gas duct 64 is a fan 10 which is driven by a motor (not shown).

The portion of the casing 65 which extends from the suction port 62 to the cartridge 66 is curved in the sectional shape of the letter U, and this curved portion can hook and rest on the top circumferential edge of the bowl 13. The lower side wall of the casing 65 is provided with a mounting means being detachable to the bowl 13. In the illustrated embodiment, the mounting means comprises a telescopic supporting member 70 which is secured to the lower side wall of the casing 65, and a suction pad 71 which is swingably secured to the supporting member 70 and can be attached to the side wall of the bowl 13. The supporting member 70 may be a member being swingable to the wall of the casing or a flexible member. Further, a spacer 72 made of a shock-absorbing material such as sponge or plastic foam is attached to the upper inner side wall of the curved portion of the casing 65. The spacer 72 is abutted against the upper lateral wall of the bowl 13. Therefore, in setting the curved portion of the casing 65 on the peripheral part of the bowl 13, the elasticity of the spacer 72 makes it possible to mount the deodorizing apparatus 61 easily in close contact with the bowl 13 and, by means of the mounting means, the deodorizing apparatus 61 so mounted can be easily secured in position. Furthermore, also due to the elasticity of the spacer 72, the deodorizing apparatus can be easily mounted in any position of the bowl 13 even when the edge of the bowl 13 varies somewhat in width.

A photosensor 73 for detecting the user sitting on the seat 14 and his leaving from the seat 14 and a warning lamp 74 as a means for alerting the user to the event that the useful life of the active carbon honeycomb 67 and chemical-supporting active carbon honeycombs 68,69 has run out are disposed at the top of the casing 65. Since the sensing direction of the photosensor 73 is obliquely upwards from the exterior to the interior of the toilet 12, the user sitting on the seat 14 and leaving the seat 14 can be positively detected, irrespective of whether the deodorizing apparatus 61 is mounted on the right side of the bowl 13 or on the left side.

The couple of the chemical-supporting active carbon honeycombs 68,69 may be substituted with a single chemical-supporting active carbon honeycomb 68 as shown in FIG. 9(B).

Figure 10:
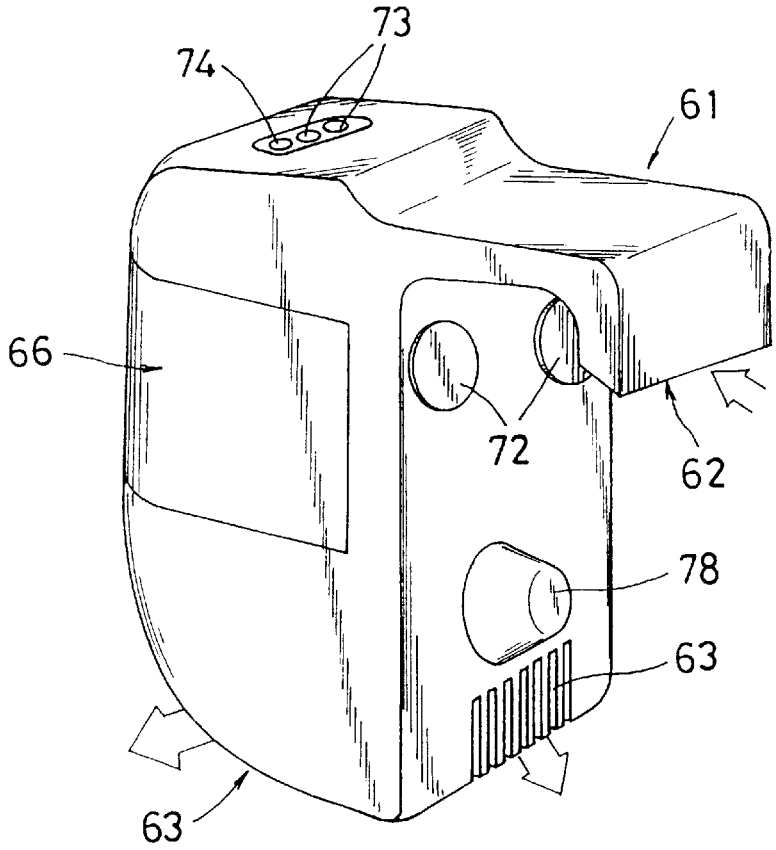
FIG. 10 is a schematic perspective view showing a still further deodorizing apparatus according to the invention.
Figure 11:
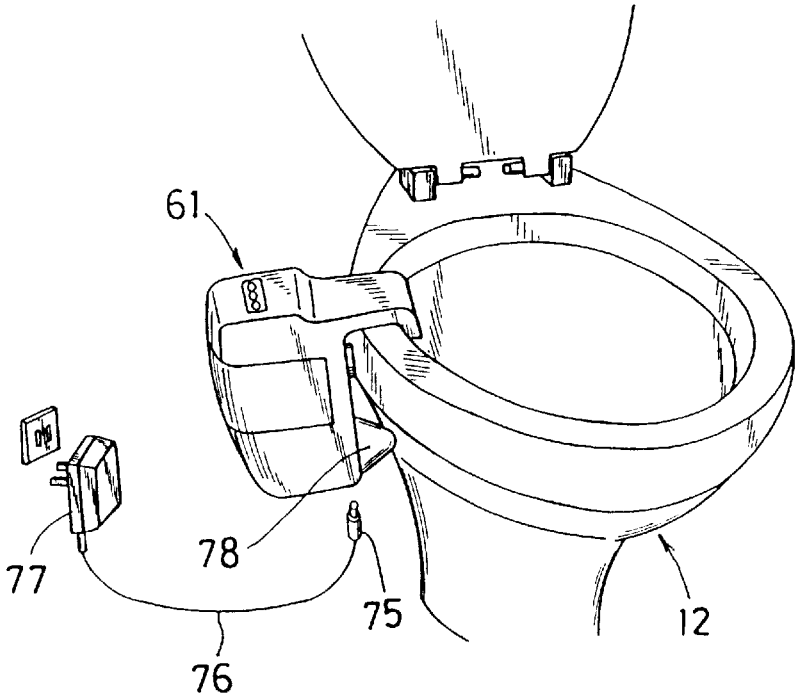
FIG. 11 is a schematic perspective view showing a toilet provided with the deodorizing apparatus of FIG. 10.

FIG. 10 is a schematic perspective view showing still another deodorizing apparatus of the invention and FIG. 11 is a schematic perspective view showing a toilet provided with the deodorizing apparatus of FIG. 10. For facilitating the mounting of the deodorizing apparatus on the toilet bowl, this embodiment includes a projecting cushioning member 78 adapted to contact the side wall of the bowl 13, which cushioning member taking the place of the supporting member 70 and suction pad 71 illustrated in FIGS. 8 and 9. It is to be understood, however, that all that is necessary is that the deodorizing apparatus can be attached to the toilet and there is no limitation on the means to that end.

The underside of the casing 65 of the deodorizing apparatus 61 is formed with a socket (not shown) for a plug 75 which is connected to a power outlet through a cord 76 for driving the motor. The power outlet mentioned above may be a direct current source, such as a storage battery, a dry battery, etc. or an alternating current source. When an alternating current source is used, an adapter 77 for conversion of the alternating current to a direct current may be connected to the cord 76 as illustrated. It is also possible to convert a high voltage to a low voltage through the adapter 77. Since the motor can then be driven with a low voltage, the amount of heat generated by the total system including the motor, a noise and electric power consumption can be reduced to ensure added safety.

The deodorizing apparatus is preferably provided with an alerting or indicator means for alerting the user to the event that the useful life of the active carbon honeycomb and chemical-supporting active carbon honeycomb has run out.

Figure 12:
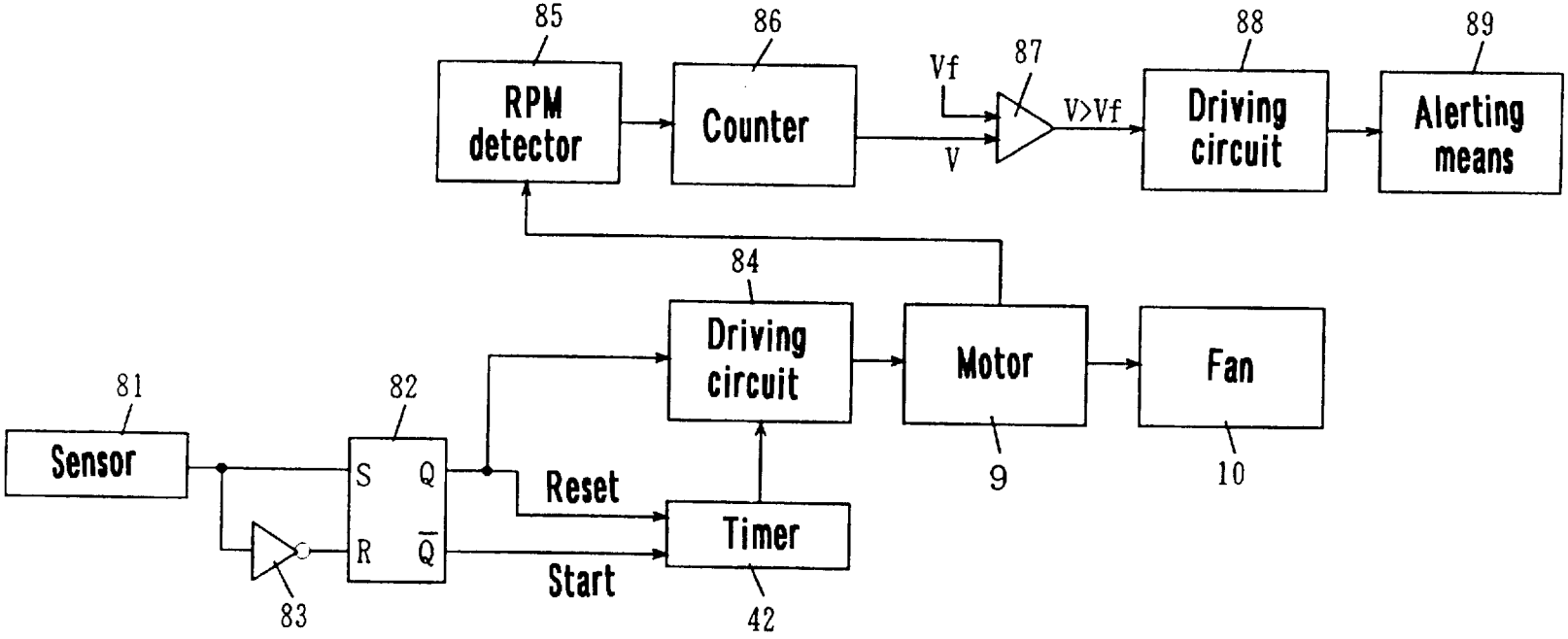
FIG. 12 is a block diagram showing the electrical system used in still another embodiment of the deodorizing apparatus of the invention.

FIG. 12 is a block diagram showing the electrical system used in a still another deodorizing apparatus of the invention. The system shown in FIG. 12 includes the system in the embodiment of FIG. 5.

In this embodiment, the sitting detection signal of the sensor 81 is applied to an S-terminal of a flip-flop 82 and, at the same time, to an R-terminal of the flip-flop 82 through an inverter 83. When the sitting action of the user is sensed by the sensor 81, its output detection signal becomes "1", the flip-flop 82 is set, and the output signal Q of the flip-flop 82 becomes "1". The output signal Q resets the timer 42. In response to the output signal Q, the driving circuit 84 is switched ON, and a driving signal is applied to the motor 9. Thereupon the motor 9 drives the fan 10 to initiate a deodorizing session.

On the other hand, when the toilet user leaves the seat 14 after defecation or urination, the output detection signal of the sensor 81 becomes "0", the flip-flop 82 is reset, and the output signal $\overline{Q}$ of the flip-flop 82 becomes "1". In response to this output signal $\overline{Q}$, the timer 42 starts counting and the driving circuit 84 goes ON so that a driving signal is applied to the motor 9 to drive the fan 10 for a predetermined time. When the time set on the timer 42 runs out, the driving circuit 84 is switched OFF to stop the motor 9.

The operating time and the number of rotations of the motor 9 are detected by an RPM detector 85 and fed to a counter 86. A comparator 87 compares the count value V of the counter 86 with a reference value Vf. The reference value Vf has been set according to the useful life of the active carbon honeycomb and the chemical-supporting active carbon honeycomb on the rational that the amount of absorption of malodor is approximately proportional to the treating time, i.e. the operating time and rpm of the motor 9.

If the result of comparison by the comparator 87 is V>Vf, a driving circuit 88 applies a driving signal to an alerting means 89 to alert the user to the fact that it is time to replace the active carbon honeycomb and the chemical-supporting active carbon honeycomb or the cartridge 66. The alerting means 89 may be a lamp 75 as used in the preceding embodiment, a buzzer or the like.

In the case of the apparatus described above, the toilet user sitting on the seat 14 actuates the fan 10 and resets the timer 42. Moreover, leaving the seat 14 starts the timer 42 and causes the fan 10 to operate for a predetermined time following defecation or urination. Furthermore, the alerting means 89 responding to information with respect to the operating time and rpm of the motor 9 alerts the user to the necessity to replace the active carbon honeycomb and the chemical-supporting active carbon honeycomb with fresh ones.

Figure 13:
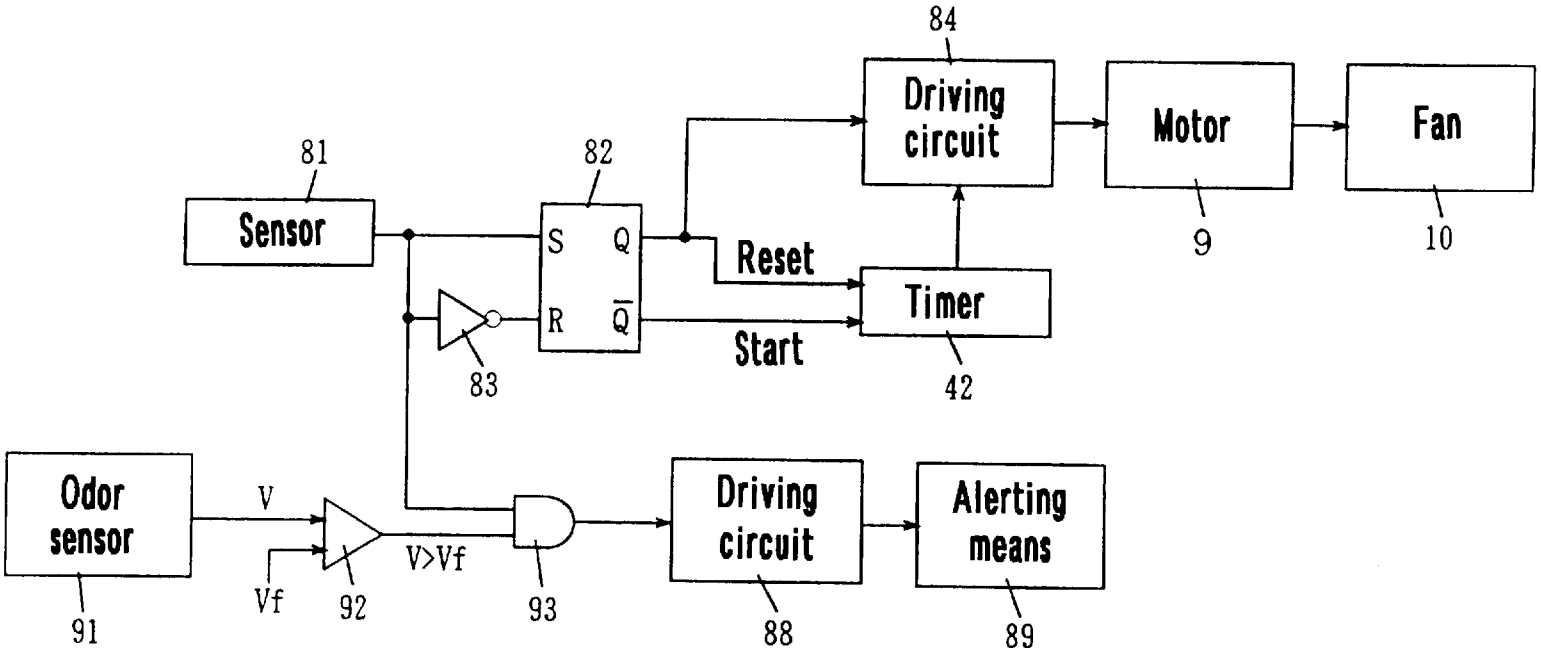
FIG. 13 is a block diagram showing the electrical system used in a still further deodorizing apparatus of the invention.

FIG. 13 is a block diagram showing the electrical system used in a still another deodorizing apparatus of the invention.

This apparatus, like the apparatus shown in FIG. 12, comprises a sensor 81 for detecting the user sitting on the seat 14 and leaving the seat 14, an RS flip-flop 82, an inverter 83, a driving circuit 84, a motor 9, a fan 10 and a timer 42. Therefore, the removal of malodor is effected by the series of events, namely starting of the fan 10 upon the user sitting on the seat 14, starting of the timer 42 upon the user leaving the seat 14, and the continued rotation of the fan 10.

An odor sensor 91 which senses the malodor to generate information on the residual life of the active carbon honeycomb and the chemical-supporting active carbon honeycomb is disposed close to the exhaust port of the deodorizing apparatus. Thus, a comparator 92 compares the detection value V of the odor sensor 91 with a reference value Vf set in a setting circuit. The reference value Vf can be associated with the organoleptically detectable concentration of malodor. When the detection value V exceeds the reference value Vf (V>Vf), an output signal "1" is applied to an AND circuit 93. As the sensor 81 detects the user sitting on the seat, a detection signal "1" is also applied to the AND circuit 93. Therefore, when the fan 10 is rotating in response to the detection signal from the sensor 81 and V>Vf, the AND circuit 93 turns the driving circuit 88 ON so that the alerting means 89 informs the user that the useful life of the active carbon and chemical-supporting active carbon honeycomb has run out.

On the other hand, even if the sensor 81 detects the user sitting on the seat and the detection signal for the AND circuit 93 is "1", the signal fed to the AND circuit 93 becomes "0" when the detection value V of the odor sensor 91 exceeds the reference value Vf. Therefore, the driving circuit 88 becomes OFF so that the alerting means 89 is not actuated.

In this apparatus, the odor sensor 91 detects the concentration of the malodor substance in the gas after deodorization by the rotating fan 10 and actuates the alerting means 89 in the event that the sensor detection value V is higher than the reference value Vf, without resort to information on the operating time and rpm of the motor 9. Therefore, the inactivation of the active carbon honeycomb and the chemical-supporting active carbon honeycomb can be accurately ascertained.

Figure 14:
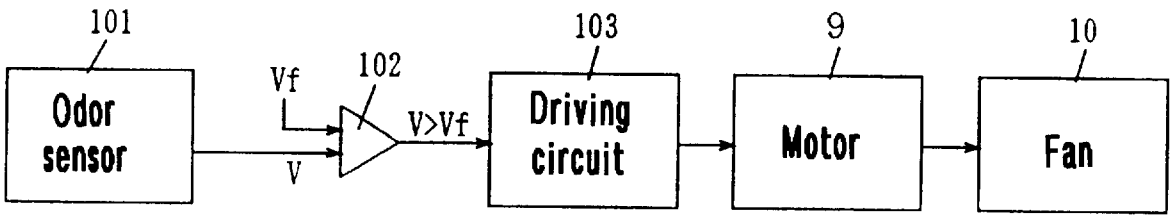
FIG. 14 is a block diagram showing the electrical system used in another yet deodorizing apparatus of the invention.

FIG. 14 is a block diagram showing the electrical system used in still another deodorizing apparatus of the invention.

This deodorizing apparatus includes an odor sensor 101 for detecting a malodor, and a motor 9 for driving a fan 10 in accordance with a detection signal from the sensor 101. In the deodorizing apparatus, regardless of sitting or leaving with respect to the seat and even in the absence of a timer, the malodor can be removed on the basis of a detection signal from the sensor 101. Thus, a comparator 102 compares the detection value V of the sensor 101 with a reference value Vf set in a setting circuit, and when the detection value V exceeds the reference value Vf (V>Vf), a driving signal is applied through a driving circuit 103 to the motor 9.

In this arrangement, the motor 9 can be driven only when the malodor concentration exceeds the reference level, for example, a concentration which can be just detected by olfactory sense, ensuring an effective utilization of the active carbon honeycomb and the chemical-supporting active carbon honeycomb.

The suction region of the casing may be of the bellows type. The fan may be installed in any position where the malodor can be aspirated, for example in the suction port side of the casing. The damper mentioned hereinbefore may be disposed in the gas duct on the opposite side to the fan. Thus, when the fan is disposed in the gas duct at either the suction port side or the exhaust port side, the damper may be disposed on the other side.

A second damper may also be installed in the exhaust port side, in addition to the one disposed in the suction port side, but this is not essential. Moreover, a dustproof cover may be installed on the suction port side of the casing.

Furthermore, in order to preclude entry of splashes from the suction port due to defecation, urination or flushing, a shield member in the form of a mesh screen or a plate extending from the casing may be disposed externally of the suction port. The exhaust region of the casing need not be provided with such protective means.

The deodorizing apparatus of the present invention is preferably used for a Western-style toilet.

The deodorizing apparatus may be mounted in any appropriate position according to the type of toilet. For example, in the case of a Japanese-style toilet, the deodorizing apparatus can be mounted on the front part of the toilet, the said automatic switch or sensor be disposed at the side of the toilet in the base region.

The deodorizing apparatus may be disposed in a receptor formed in the toilet box 16 shown in FIG. 2, for instance. Moreover, by taking advantage of the clearance formed by the projections 14*a* between the bowl 13 and the seat 14, the suction part of the casing may be installed under the seat which is generally formed in a curved sectional configuration.

The following description up to the 4th paragraph of page 33 in this specification is intended to generally illustrate the present invention without reference to drawing.

The flow rate of the fan can be any suitable rate as long as the malodor component can be effectively eliminated, and generally will be in the range of about 10 to 500 liters/minute, preferably about 25 to 250 liters/minute, and more preferably about 50 to 200 liters/minute. If the flow rate is less than 10 liters/minute, the deodorizing efficiency will not be sufficient, while a flow rate in excess of 500 liters/minute will give a cold sensation to the user during urination or the like.

As is apparent from the test examples, the deodorizing apparatus of the present invention is capable of eliminating the toilet malodor almost completely even after long-term continued operation and the useful life of its deodorizing function is generally more than one year.

The active carbon honeycomb 7 described above may contain an optional kind of binder only if its active carbon content is not less than about 30 weight percent. The BET specific surface area of the active carbon honeycomb 7 is generally not less than 200 $m^2/g$, preferably not less than 400 $m^2/g$ and more desirably not less than 500 $m^2/g$. The number of cells in the active carbon honeycomb 7 is about 30 to 1,500 cells/square inch and preferably about 50 to 1,000 cells/square inch. The active carbon honeycomb 7 may be comprised of a single layer or of a plurality of layers. The thickness of the active carbon honeycomb can be chosen within the range which insures a sufficient deodorizing efficiency, being not less than about 5 mm per layer, preferably not less than 7.5 mm per layer (e.g. about 7.5 to 100 mm), and more preferably not less than 10 mm (e.g. about 10 to 30 mm) per layer.

The active carbon honeycomb may be prepared by the conventional manner. The active carbon honeycomb can be also produced, after molding the starting material into the honeycomb structure, by activating the molding article according to the conventional procedure. When the molding article is sintered at a high temperature, the sintering may be conducted in the presence of an inert gas such as nitrogen, carbon dioxide, helium and the like, or under covering the molding article with coke and so on.

The active carbon honeycomb removes, by physical absorption, a variety of gas components such as oils, hydrocarbons, disulfides and, by chemical adsorption, hydrogen sulfide, nitrogen oxide, sulfur oxide, mercaptans and so on.

The chemical or chemicals supported on the active carbon honeycomb 8 can be those reagents which are capable of removing those substances which cannot be removed by the active carbon honeycomb 7, such as amines, aldehydes, sulfides, carbon monoxide, etc. and are preferably selected from among acids (inorganic acids and/or organic acids), bromine and compounds of platinum group elements.

The inorganic acids include, for example, phosphoric acid, sulfuric acid, etc., the organic acids include, for example, oxalic acid, citric acid, malic acid and so on.

Acid can be supported on active carbon by treating the active carbon honeycomb with an aqueous solution of the acid by spraying, impregnation or dipping. Alternatively, an aqueous solution of the acid can be mixed with the starting materials for molding into a honeycomb. If necessary, the honeycomb may be dried by the conventional procedure. The amount of the acid to be supported relative to the active carbon honeycomb is 1 to 60 weight %, preferably 2 to 50 weight % and more preferably 5 to 40 weight %.

A bromine-supporting active carbon honeycomb can be prepared by applying liquid bromine to an active carbon honeycomb by spraying, impregnation or dipping, or gaseous bromine thereto by contacting. The amount of supported bromine relative to the active carbon honeycomb is 1 to 30 weight %, preferably 2 to 20 weight %, and more preferably 5 to 15 weight %.

The platinum group element includes, among others, platinum, iridium, osmium, palladium, rhodium, ruthenium and gold. The amount of a compound of such platinum group element to be supported on the active carbon honeycomb is 0.1 to 20 weight %, preferably 0.25 to 15 weight %, and more preferably 0.5 to 10 weight %, as the element.

The active carbon honeycomb supporting the above compound of a platinum group element can be prepared by a method which comprises applying a solution of such compound in hydrochloric acid, hydrobromic acid, hydroiodic acid, hydrofluoric acid, nitric acid, sulfuric acid or the like by spraying, impregnation or dipping. As an alternative, a solution of the compound in the acids is mixed with the staring materials before molding into the honeycomb. If necessary, the honeycomb may be dried or sintered by conventional techniques. The drying or sintering temperature is 40° to 500° C., preferably 50° to 400° C., and more preferably 60° to 350° C. The drying or sintering can be conducted at subatmospheric, atmospheric or supratmospheric pressure in the presence of air, nitrogen gas, carbon dioxide gas or hot combustion gas.

The effect of gas treatment is more enhanced when, as the chemical supported, a compound of a platinum group element is used in combination with at least one component of the group consisting of compounds of Ti, V, Cr, Mn, Fe, Co, Ni, Cu and Ag. Such a honeycomb can be prepared in the same manner as the chemical-supporting active carbon honeycomb supporting a platinum group compound alone. In this case, the ratio of the metal compound to the platinum group compound (metal/element ratio by weight) is 0.1 to 500, preferably 0.5 to 250, and more preferably 1 to 100.

This honeycomb can be dried or sintered, if necessary, similar to the preparation of the active carbon honeycomb supporting the platinum group compound.

When the molding article is sintered at a high temperature, the sintering may be conducted in the presence of an inert gas.

Among these chemical-supporting active carbon honeycombs, an acid-supporting active carbon honeycomb, particularly phosphoric acid-supporting active carbon honeycomb is preferable.

While the use of only one kind of chemical-supporting active carbon honeycomb is generally sufficient, a further improvement in deodorizing effect can be achieved by using two or more different kinds of such honeycombs.

The preferred gas treatment means comprises single layer of the active carbon honeycomb which does not support chemical and single layer of the phosphoric acid-supporting active carbon honeycomb in combination.

Figure 15:
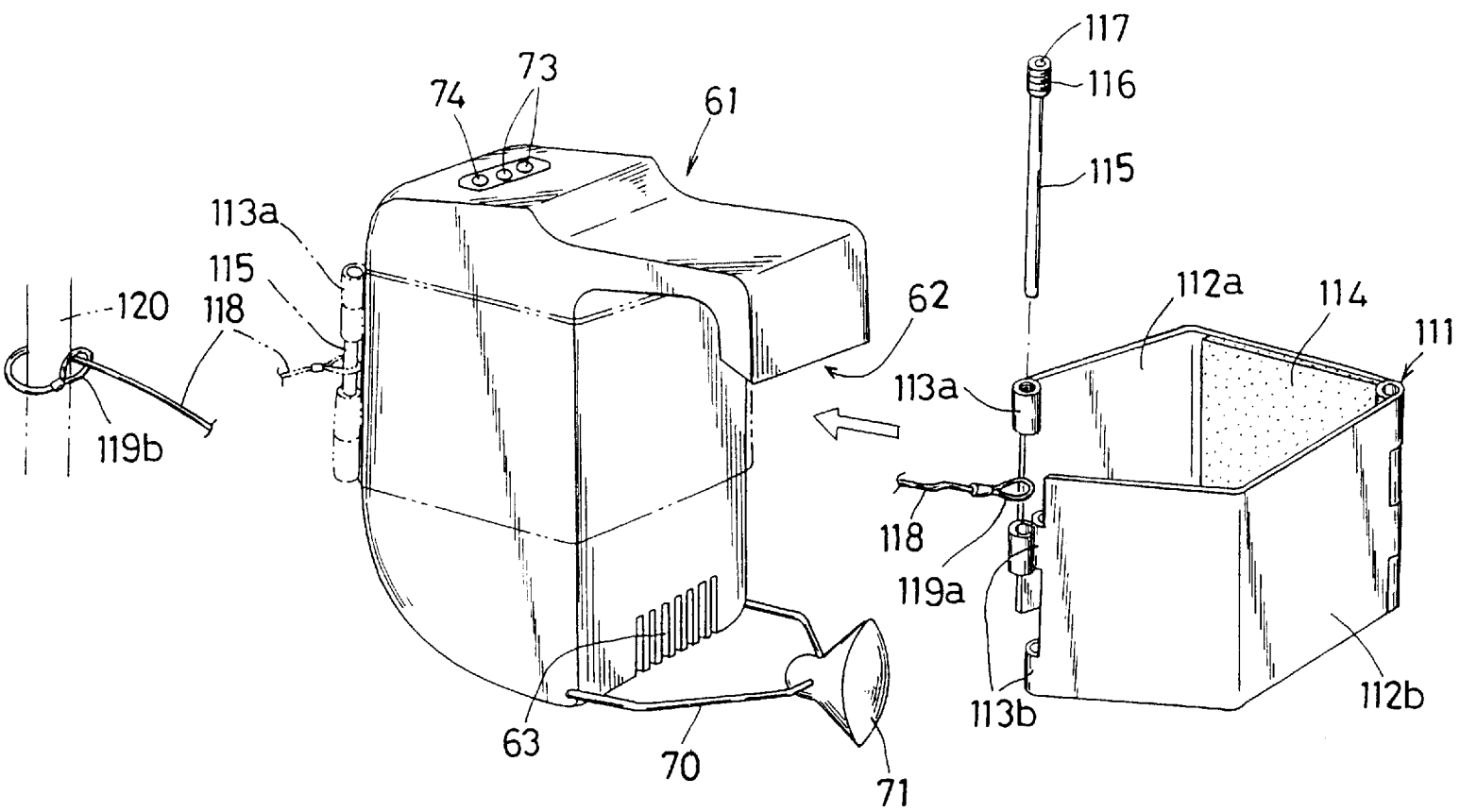
FIG. 15 is a perspective disassembled view showing a deodorizing apparatus provided with an antitheft device.

The deodorizing apparatus of the present invention may be provided with an antitheft device. FIG. 15 is a disassembled perspective view showing the deodorizing apparatus provided with the antitheft device. In this view, the like parts are designated by the like reference numerals used in FIG. 8.

The antitheft device comprises a couple of rigid tough bands 112*a* and 112*b*, which are made of, for example, a metal and are swingably connected to each other through a hinge 111, hollow cylindrical members 113*a*, 113*b* formed at the edge of the bands 112*a*,112*b* in staggered relation, and a pin 115 to be inserted into the bores of the cylindrical members as aligned. The surface of one band 112*a* which is adjacent to the hinge 111 is rigidly secured to the inner side wall of the casing of the deodorizing apparatus 61 by means of an adhesive 114. The other band 112*b* is free to turn relative to the band 112*a* via the hinge 111.

One end of the pin 115 is formed with a screw 116 which is larger in diameter than a shaft portion of the pin 115. The screw 116 is screwed into a thread formed on the internal wall of the corresponding hollow cylindrical member 113*a*. In addition, the end face of the screw 116 is formed with a hexagonal hole 117 which is not conforming to the Japanese Industrial Standard (JIS).

This antitheft device is further provided with a wire 118 which is formed with a ring 119*a* at one end and a ring 119*b* at the other end. The pin 115 is passed into one ring 119*a*, while the other ring 119*b* is available for securing the device to a stationary member such as a water pipe 120 so that it cannot be removed. Thus, with the wire 118 being hooked on, or wound round, the water pipe 120, one ring 119*b* is passed through the other ring 119*a* and the pin 115 is then passed into the ring 119*a* and the hollow cylindrical members 113*a*,113*b*. Then, using a special screwdriver compatible with the hexagonal hole 117, the screw 116 of the pin 115 is engaged with the thread of the hollow cylindrical member 113. In this arrangement, since the hexagonal hole 117 is not conforming to the JIS, the band 112*b* cannot be turned apart using an ordinary screwdriver. Therefore, theft of the deodorizing apparatus can be successfully prevented. Furthermore, since the bands 112*a*,112*b* are positioned on the cartridge-mounting part of the casing, theft of the cartridge can also be prevented.

It should be understood that, in this embodiment, the bands can be any kinds of bands that fit to the contour of the casing of the deodorizing apparatus and cannot be detached from the apparatus.

Figure 16:
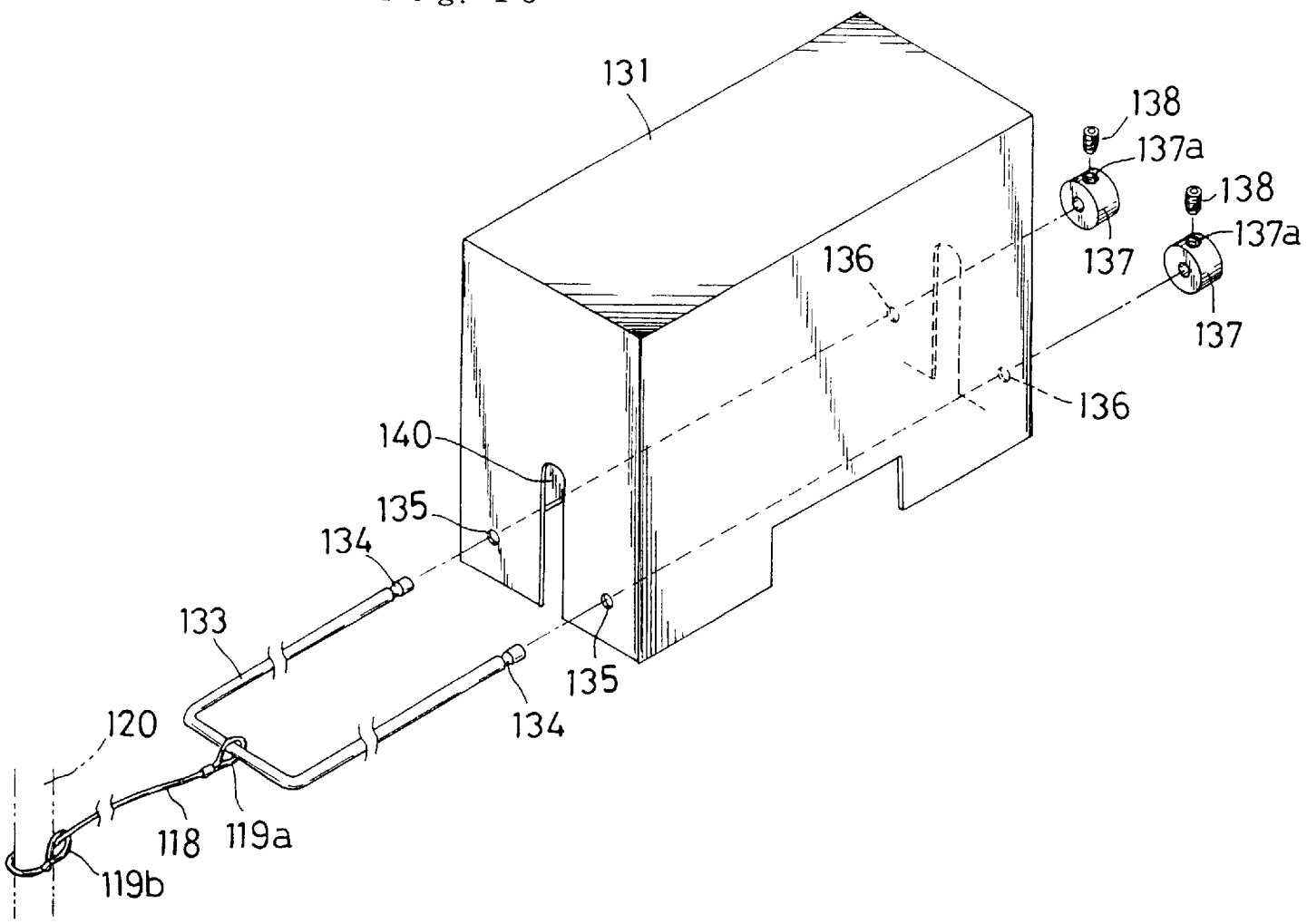
FIG. 16 is a schematic perspective disassembled view showing an antitheft device for the battery used for driving the motor of the deodorizing apparatus.
Figure 17:
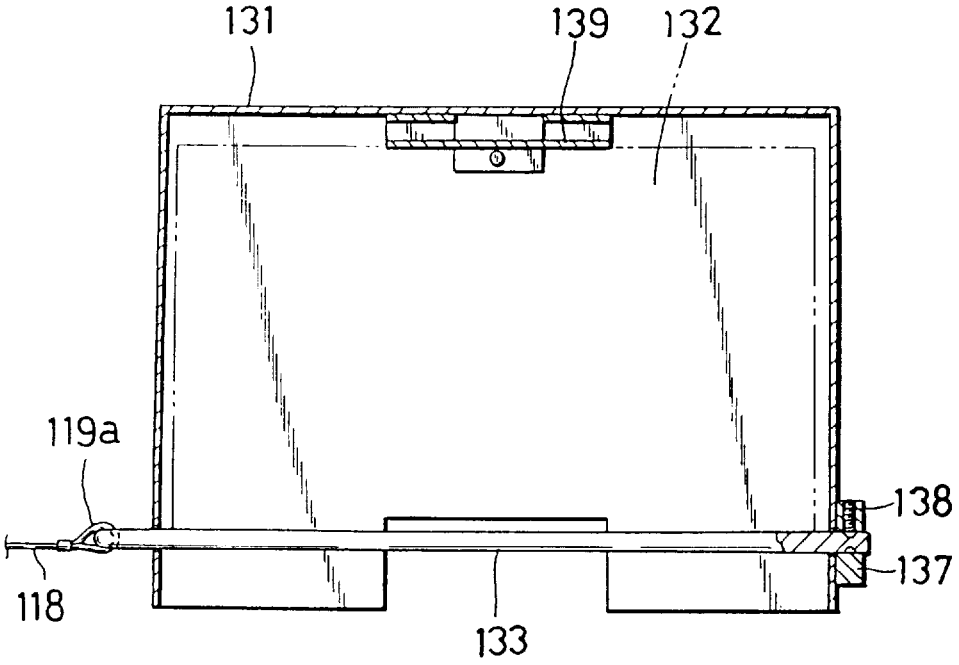
FIG. 17 is a longitudinal section view of the antitheft device shown in FIG. 16.

FIG. 16 is a schematic disassembled perspective view showing an antitheft device for the battery which is used in driving the motor of the deodorizing apparatus, and FIG. 17 is a longitudinal section view showing the antitheft device of FIG. 16.

This apparatus includes a box 131 housing a battery 132 and a U-shaped rod 133 adapted to support the battery 132. The peripheral surface of the end portion of each shank of the rod is formed with a groove 134.

The U-shaped rod 133 is inserted through holes 135,136 formed on both end walls of the box 131. Thus, the rod 133 is inserted from the holes 135 at one end of the box 131 and the ends of the rod 133 which extend out from the holes 136 at the other end of the box are fitted with ring members 137,137.

A screw 138 is threaded into the internally threaded hole 137*a* of the ring member 137. This screw 138 is also screwed on and off with a special screwdriver applied to a hexagonal recess which is formed at its end face and is not conforming to the JIS as previously mentioned. When the screw 138 is screwed in, its end fits into the corresponding groove 134 of the rod 133 so as to preclude displacement of the U-shaped rod 133. The reference numeral 139 indicates an electrode protector for the battery 132, and the cord connected to the battery 132 extends out of a slit 140 formed at wall of the box 131.

Only one end portion of the U-shaped rod may be fixed with the sing member and the screw.

Passed onto the base portion of the U-shaped rod 133 is one ring 119*a* of the wire 118 in the same manner as described above. The other ring 119*b* of the wire 118 is available for undetachable connection to the water pipe 120, for instance.

In this arrangement, displacement of the U-shaped rod 133 can be prevented by the special screws 138 and, at the same time, the U-shaped rod 133 can be connected undetachably to the water pipe 120 or the like, so that theft of the battery 132 may be prevented.

In the apparatus illustrated in FIGS. 15 to 17, the hexagonal hole or recess may be substituted by a hole or recess which is otherwise configured and not defined in the industrial standards, for example a pentagonal or other polygonal hole or recess. Moreover, a chain or any other conventional connector means may be used instead of the wire.

The antitheft devices are useful for preventing, from theft, the deodorizing apparatus and the battery disposed at a toilet of a hotel, an conference hall, a building for business and the like, and also useful for preventing from mischief.

The following test examples are intended to illustrate the invention in further detail and should not be construed as defining the metes and bounds of the invention.

EXAMPLES

Test Example 1

A deodorizing apparatus as shown in FIG. 3 was constructed. Thus, an active carbon honeycomb (300 cells/square inch, sized 44 mm×58 mm, 19 mm thick), a chemical-supporting active carbon honeycomb (300 cells/square inch, sized 44 mm×58 mm, 19 mm thick) supporting 25 weight % of phosphoric acid, and a sirocco fan were installed in that sequence within a casing. The fan was started by switching an automatic switch ON to aspirate an atmosphere containing 1 ppm of $H_2S$, 1 ppm of $CH_3SH$ and 1 ppm of $NH_3$ at a flow rate of 120 liters/minute.

A deodorizing trial was conducted under the above conditions for 100 consecutive hours, and the gas emerging from the exhaust port of the apparatus was analyzed by gas chromatography. As a result, none of the three components, $H_2S$, $CH_3SH$ and $NH_3$, were detected, indicating that the elimination rate was approximately 100%.

Assuming that the stool time was 1/15 hours and the concentrations of the malodor components were 1/20 of the concentrations used in the above experiment, the useful life of the apparatus was calculated from the data generated by the 100-hour continuous operation. The useful life was found to about 2 to 3 years, indicating that a long-term elimination of malodor with high efficiency can be insured.

Test Example 2

The deodorizing apparatus of Test Example 1 was mounted on a toilet as illustrated in FIG. 4. The timer was set so that the fan would be driven for 3 minutes following the user leaving the stool seat by the automatic switch.

A 10-month monitor test using 10 panelists revealed that none of the monitors sensed malodors on any occasion before, during or after using the toilet.

What is claimed is:

1. A deodorizing apparatus comprising a gas duct having a suction port to be disposed within a toilet bowl and an exhaust port to be disposed outside the toilet bowl; and an active carbon honeycomb and a phosphoric acid-supporting active carbon honeycomb as disposed in that order in said gas duct in the direction from said suction port to said exhaust port.

2. A deodorizing apparatus according to claim 1 wherein a fan is disposed within said gas duct on the downstream side of said phosphoric acid-supporting active carbon honeycomb.

3. A deodorizing apparatus according to claim 2 wherein said fan provides a gas flow of 10 to 500 liters per minute.

4. A deodorizing apparatus according to claim 1 wherein a fan is disposed within said gas duct either in said suction port side or in said exhaust port side, and a damper for opening and closing said gas duct in response to the action of said fan is disposed in the position where the fan is not located.

5. A deodorizing apparatus according to claim 4 wherein a fan is disposed within said gas duct in said exhaust port side, and a damper for opening and closing said gas duct in response to the action of said fan is disposed within said gas duct in said suction port side.

6. A deodorizing apparatus according to claim 1 wherein the suction port side of a casing defining said gas duct is bent in the shape of the letter U so that it can rest on the top circumferential edge of a toilet bowl.

7. A deodorizing apparatus according to claim 1 wherein said active carbon honeycomb and said phosphoric acid-supporting active carbon honeycomb respectively have a BET specific surface area of not less than 200 $m^2/g$.

8. A deodorizing apparatus according to claim 1 wherein the number of cells in each of said active carbon honeycomb and said phosphoric acid-supporting active carbon honeycomb is 30 to 1500 cells/square inch.

9. A deodorizing apparatus according to claim 1 wherein the thickness per layer of said active carbon honeycomb and of said phosphoric chemical-supporting honeycomb is not less than 5 mm.

10. A deodorizing apparatus according to claim 1 wherein the proportion of said phosphoric acid to said active carbon honeycomb is 1 to 60 weight percent.

11. A deodorizing apparatus according to claim 1 which further comprises a sensor means for detecting the user sitting on the stool seat and leaving the stool seat, a driving means operative in response to a sitting detection signal from said sensor means to drive a fan in said gas duct, and a control means operative in response to a leaving detection signal from said sensor means to control the operation time of said driving means.

12. A deodorizing apparatus according to claim 11 wherein said sensor means for detecting the user sitting on the stool seat and leaving the stool seat is a photosensor set obliquely upwards from the exterior side of the toilet to the interior side.

13. A deodorizing apparatus according to claim 11 wherein said control means is a timer means which allows said driving means to operate for at least 10 seconds in response to said leaving detection signal.

14. A deodorizing apparatus according to claim 11 wherein said control means comprises a timer means for allowing said driving means to operate for a preset time, and a set/reset means for resetting said timer means in response to said sitting detection signal from said sensor means and setting said timer means in response to said leaving detection signal from said sensor means.

15. A deodorizing apparatus according to claim 11 which further comprises a counting means for measuring a cumulative operation time of said driving means, a comparator means for comparing the count value of said counting means with a reference value corresponding to a useful life of said active carbon honeycomb and said chemical-supporting active carbon honeycomb, and an alerting means for informing the end of the useful life of said active carbon honeycombs when said count value of said counting means is larger than said reference value.

16. A toilet provided with a deodorizing apparatus which comprises a gas duct having a suction port being disposed within a toilet bowl and an exhaust port being disposed outside said toilet bowl; and an active carbon honeycomb and a phosphoric acid-supporting active carbon honeycomb as disposed within said gas duct in that order in the direction from said suction port to said exhaust port.

17. A toilet provided with a deodorizing apparatus according to claim 16 wherein said toilet bowl is provided with a receptor means extending from the interior to the exterior thereof and adapted to be opened and closed, and said deodorizing apparatus is disposed in said receptor means with said suction port communicating with the interior of said toilet bowl.

18. A toilet provided with a deodorizing apparatus according to claim 16 wherein the suction port side of a casing is bent in the shape of the letter U, and the bent portion rests on the top circumferential edge of the toilet bowl with its suction port communicating with the interior of the toilet bowl.

19. A toilet provided with a deodorizing apparatus according to claim 16 wherein the suction port side of a casing is bent in the shape of the letter U, the bent portion resting on the top circumferential edge of the toilet bowl with said suction port communicating with the interior of the toilet bowl, a cushioning spacer secured to an upper inner side wall of the U bend is abutted against an upper lateral wall of the toilet bowl, with a mounting means secured to a lower inner side wall of said bend being detachably attached to a lateral wall of the toilet bowl.

20. A deodorizing apparatus comprising a gas duct having a suction port to be disposed within a toilet bowl and an exhaust port to be disposed outside the toilet bowl;

an active carbon honeycomb and a chemical-supporting active carbon honeycomb as disposed in that order in said gas duct in the direction from said suction port to said exhaust port, and said honeycombs having respectively a BET specific surface area of not less than 200 $m^2/g$, the number of cells of 30 to 1500 cells/square inch, and thickness per layer of not less than 5 mm;

a fan disposed within said gas duct on the downstream side of said chemical-supporting active carbon honeycomb;

a photosensing means set obliquely upwards from the exterior side of the toilet to the interior side for detecting the user sitting on the stool seat and leaving the stool seat;

a driving means operative in response to a sitting detection signal from said photosensing means to drive said fan; and a timer means which control the operation time of said driving means to operate for at least 10 seconds in response to said leaving detection signal from said photosensing means.

21. A deodorizing apparatus according to claim 20 wherein said chemical-supporting active carbon honeycomb is an active carbon honeycomb supporting phosphoric acid.

22. A toilet provided with a deodorizing apparatus which comprises a gas duct having a suction port being disposed within a toilet bowl and an exhaust port being disposed outside said toilet bowl;

an active carbon honeycomb and a phosphoric acid-supporting active carbon honeycomb as disposed within said gas duct in that order in the direction from said suction port to said exhaust port, and said honeycombs have respectively a BET specific surface area of not less than 200 $m^2/g$, the number of cells of 30 to 1500 cells/square inch, and thickness per layer of not less than 5 mm;

a fan disposed within said gas duct on the downstream side of said chemical-supporting active carbon honeycomb;

a photosensing means set obliquely upwards from the exterior side of the toilet to the interior side for detecting the user sitting on the stool seat and leaving the stool seat;

a driving means operative in response to a sitting detection signal from said photosensing means to drive said fan; and a timer means which control the operation time of said driving means to operate for at least 10 seconds in response to said leaving detection signal from said photosensing means.

23. A toilet provided with a deodorizing apparatus according to claim 22 wherein said acid-supporting active carbon honeycomb is an active carbon honeycomb supporting phosphoric acid.

* * * * *